United States Patent [19]

Hendriks

[11] 4,074,485

[45] Feb. 21, 1978

[54] SAFETY WALL FOR A STORAGE TANK

[75] Inventor: Nicolaas Arie Hendriks, Rotterdam, Netherlands

[73] Assignee: Bouwmaatschappij Nederhorst B. V., Gouda, Netherlands

[21] Appl. No.: 791,466

[22] Filed: Apr. 27, 1977

Related U.S. Application Data

[63] Continuation of Ser. No. 631,849, Nov. 13, 1975, abandoned.

[30] Foreign Application Priority Data

May 13, 1975 Netherlands ..... 7505591

[51] Int. Cl.[2] ..... E04G 11/06

[52] U.S. Cl. ..... 52/224; 52/247; 52/249

[58] Field of Search ..... 52/224, 249, 247, 245, 52/230, 248

[56] References Cited

U.S. PATENT DOCUMENTS

| | | | |
|---|---|---|---|
| 1,041,159 | 10/1912 | Poyser | 52/248 |
| 1,964,870 | 7/1934 | Cappell | 52/249 |
| 2,185,749 | 1/1940 | Kenedy | 52/224 |
| 4,015,383 | 4/1977 | Crowley | 52/224 |

FOREIGN PATENT DOCUMENTS

| | | | |
|---|---|---|---|
| 1,383,795 | 11/1964 | France | 52/249 |
| 1,264,736 | 3/1968 | Germany | 52/249 |
| 948,096 | 1/1964 | United Kingdom | 52/224 |
| 1,154,011 | 6/1969 | United Kingdom | 52/249 |

*Primary Examiner*—Ernest R. Purser
*Assistant Examiner*—Henry Raduazo
*Attorney, Agent, or Firm*—Scully, Scott, Murphy & Presser

[57] ABSTRACT

Safety wall for a storage tank containing liquids which are dangerous to the environment, such as liquid natural gas, acrylonitrile, ethylene, hydrocyanic acid compounds etc., which wall, made of concrete, surrounds the storage tank with an interspace and is freely mounted on a supporting floor, while it is tensioned circumferentially by means of tensioning wires which do not bond to the concrete.

2 Claims, 6 Drawing Figures

SAFETY WALL FOR A STORAGE TANK

This application is a continuation application of Ser. No. 631,849; filed Nov. 13, 1975 and now abandoned.

This invention relates to a safety wall for a storage tank containing liquids which are dangerous to the environment, such as liquid natural gas, acrylonitrile, ammonia, ethylene, propylene, hydrocyanic acid compounds and other such liquids. These liquids are a source of dangers both from interior and exterior causes. There may be calamities in the form of fire, explosion, leakage, sabotage and material collapse, like cracking of the storage tank wall. The use of a safety wall aims at prevention of the consequences of such an event, like spreading of poisonous materials in the atmosphere or in the ground water, spreading of burning materials or radiant heat in the surroundings.

For a safety wall to be effective it has to meet a number of requirements. The safety wall must be resistant to the liquid pressure when the storage tank collapses, to the dynamic load in case of a calamity, to material stresses resulting from extremely low temperature of the tank contents, to loads due to natural causes, like gales, sun rays, flooding. Other requirements follow from the necessity that the safety wall must seal the enclosed space free of leakage and will not require maintenance. Furthermore it must be possible to build a safety wall during the operational stage of a filled storage tank, if desired.

To meet these requirements it is well-known to form the safety wall as a cylindrical, circumferentially closed and prestressed concrete wall surrounding the tank with relatively small interspace and resting freely on a foundation.

In order to achieve maximum safety with the selected dimensions, the safety wall according to the invention is constructed as a wall which is circumferentially prestressed by means of tensioning wires which do not bond to the concrete. The tensioning wires are preferably received in a special grease containing flexible envelope, for example a plastic tube. The wires can then be tensioned well, while overlapping one another at their ends.

A particular advantage obtained by this manner of prestressing the wall resides in the elasticity of the wall as a whole and its capacity of restoration upon initial cracking as a result of a calamity.

When the wall of a storage tank cracks, in which connection the lower end of the wall is most vulnerable, very great dynamic forces will be liberated when the liquid flows out of a filled tank, the contents of which may amount to thousands and thousands of cubic metres and the height of which may be tens of metres. The local outflow of the liquid causes a pulsation in the body liquid which almost immediately also cracks the tank wall diametrically opposite the initial crack. The liquid then subjects the diametrically opposed zones of the safety wall to such forces as to cause the wall to change temporarily from a circular shape into an elliptical shape. The power to elastically take up such a load is enhanced by applying the tensioning wires which are not bonded to the concrete.

If in such an event, or in case of sabotage or an other calamity, like an explosion, the safety wall itself is cracked, the tensioning wires which are not bonded to the concrete permit the cracking, by sliding relative to the concrete, without also being excessively loaded themselves, as a result of which the crack in the wall closes again after the calamity forces have ceased. Tensioning wires bonded to the concrete, under these conditions, would locally be loaded beyond their yielding point or breaking point and then no longer be capable of closing the crack again.

For the installation of such a safety wall around a filled tank during its operational stage, according to the invention, foundations are laid for a circular supporting floor independently of the supporting floor of the tank, on which circular supporting floor the safety wall is built. The interspace between the circular supporting floor and the tank supporting floor is bridged by a circular floor which is laid with some freedom of movement on the circular supporting and the tank supporting floor so that when the tank is filled and emptied the vertical displacement relative to the safety wall can be undergonewithout difficulty and said wall is free to deform elastically in case of a calamity.

In all of the possible conditions mentioned heretofore, sealing must be ensured between the safety wall and the supporting floor, or the circular supporting floor and also the sealing of the circular floor, mounted between the circular supporting floor and the tank floor, relative to said supporting floors.

Sealing can be improved by means of an interior or exterior ring formed by an elevation of the supporting floor or circular supporting floor, which elevated ring will also function as a centering ring. The ring is concentric to the safety wall and spaced from said wall to leave it some freedom of movement.

In a safety wall construction according to the invention, elastically deformable sealing material is provided between the lower end of the safety wall and the adjoining surface of the supporting floor or circular supporting floor or ring elevation thereof. Also the intermediate circular floor, if applied, is sealed with respect to the adjoining parts by means of elastic sealing material. A preferred material for these seals is cellular material; for the type of material account is to be taken of the chemical characteristics of the liquid the tank must contain. While maintaining the seal, this material permits the relative movements that may occur as a result of a calamity, shrinking and temperature effect, and also variation in weight of the tank.

Another solution according to the invention is overlapping of the seams with preferably plating rings flexibilized by wrinkles, which rings can themselves be arranged via inserted elastic sealing material.

The invention will be illustrated hereinafter with reference to the accompanying drawings showing some embodiments in diagrammatic outline.

Figure 1:
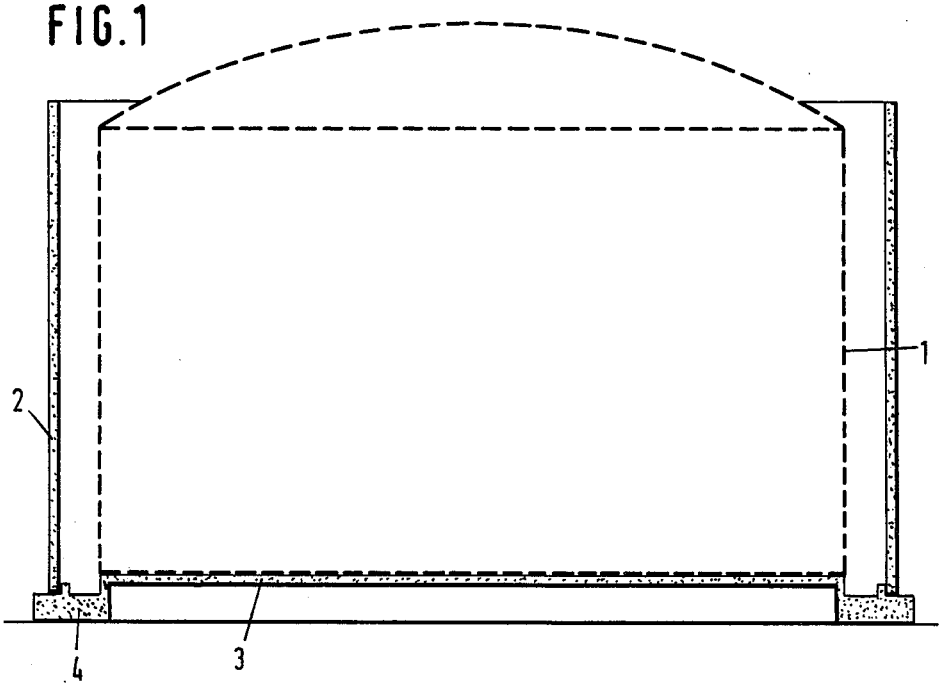
FIG. 1 shows in vertical section a tank in broken lines inside a safety wall supported by a common floor.
Figure 2:
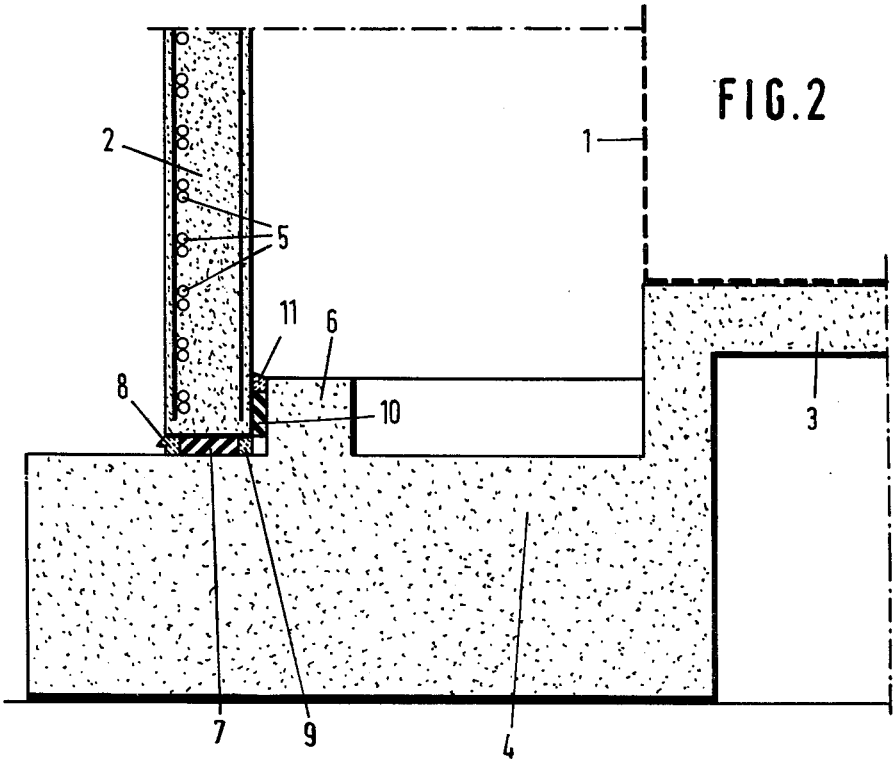
FIG. 2 shows on an enlarged scale of the construction of FIG. 1 a detail in vertical section.

In FIGS. 1 and 2, 1 represents the tank, 2 the safety wall, 3 the tank supporting floor which is enlarged with a recessed circular part 4 for supporting the wall 2. The possibly required substructure of the floor 3, 4 is not shown.

The wall 2 is prestressed by means of tensioning wires 5 in plastic tubes, which for the rest are filled with a special grease.

On floor part 4 is formed a collar ring 6. The wall 2 rests on an annular layer 7 of cellular rubber of special composition, on both sides of layer 7 ring layers 8 and 9 of expanded cement or polystyrene are provided. Between the wall 2 and the collar ring 6 a seal 10 of cellular rubber material is pressed, closed on the top by a cement ring 11.

Figure 4:
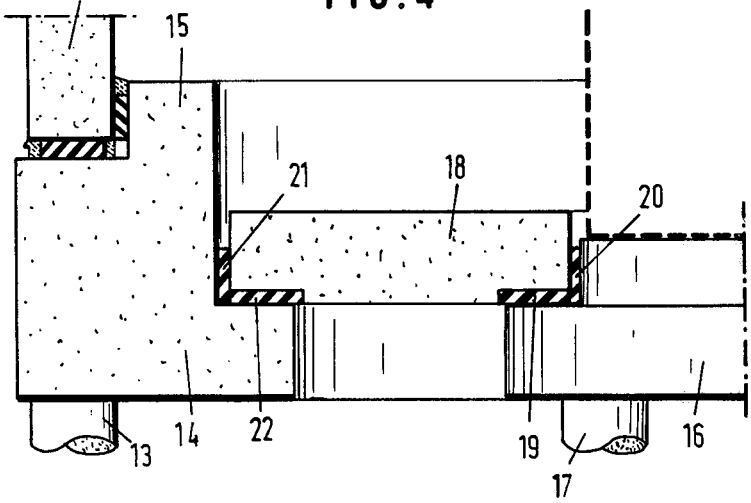
FIG. 4 shows a detail like in FIG. 2 of still another embodiment.

In FIG. 4 the safety wall 12 rests on a circular supporting floor 14 mounted separately on a piled foundation 13, said circular supporting floor having a centering and sealing collar 15. The sealing of the wall is like that shown in FIG. 2. Between the tank supporting floor 16, resting on a piled foundation 17 and the circular supporting floor 14, a circular floor 18 is provided, resting on floors 14 and 16 and laterally sealed via elastic cellular rubber seals 19-22, of which parts 19 and 22 are accommodated in a recess in ring 18.

Figure 5:
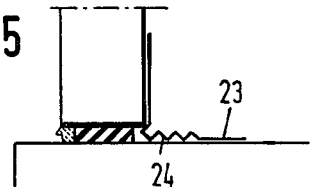
FIGS. 5 and 6 show on a reduced scale corresponding detailed representations of two other embodiments.

In FIG. 5 sealing is effected by a sheet metal ring 23 of L-shaped section and elasticity wrinkles 24. Again sealing material is inserted between ring 23 and the wall and floor.

Figure 6:
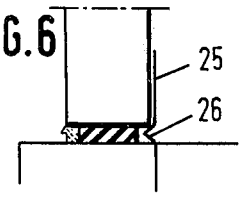

In FIG. 6 a sheet metal seal 25 is used, having an elasticity wrinkle 26 and being embedded with the subjacent portion in the floor concrete.

Figure 3:
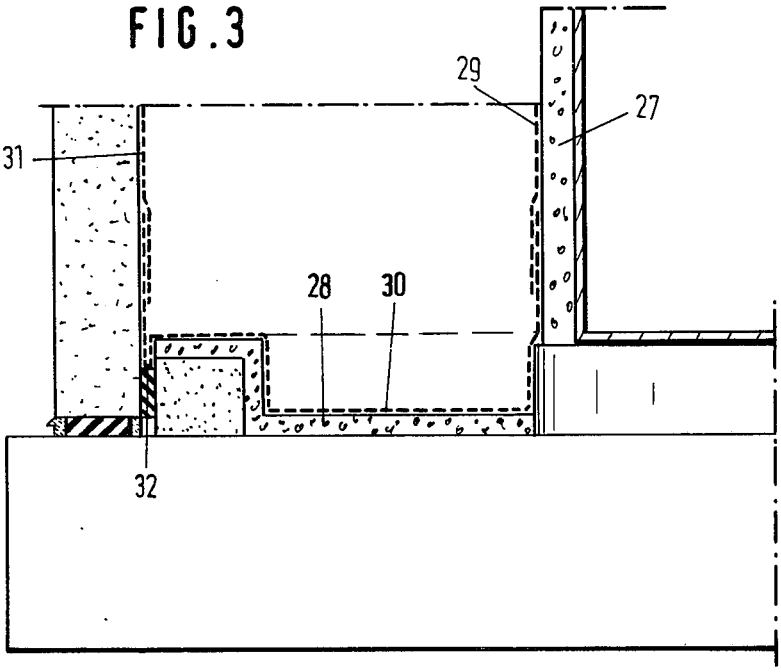
FIG. 3 shows a detail like in FIG. 2 of a different embodiment.

In the embodiment shown in FIG. 3 an insulating lining 27 of the tank is applied, and also a coating 28 of the circular floor part. For purposes of sealing, overlapping layers 29, 30, 31 of a flexible synthetic material are applied, of which layer 31 is folded up at 32 between the safety wall and the centering ring so that relative movement between the safety wall and the centering ring is possible. Instead of synthetic material, layers 29-31 can also be made of metal.

I claim:

1. A safety wall for a storage tank containing liquids dangerous to the environment, such as liquid natural gas, acrylonitrile, ammonia, ethylene, propylene, propane and hydrocyanic acid compounds, said safety wall formed by a cylindrical, circumferentially closed and prestressed concrete wall surrounding the tank with relatively small interspace, a horizontal supporting floor, said safety wall resting freely on said horizontal supporting floor, tensioning wires circumferentially prestressing said wall, tubes in said wall accommodating said tensioning wires which do not bond to the concrete, a circular supporting floor on which said safety wall rests adjacent a centering ring formed by an elevation of said circular supporting floor concentrically within said safety wall and surrounding the tank with small interspace, and elastically deformable sealing material being arranged between the lower end of the safety wall and the adjoining surfaces of both the wall supporting floor and said ring, said circular supporting floor being supported independently of the supporting floor of the tank, a circular floor bridging the spacing between the circular supporting floor and the tank supporting floor, said circular floor being laid with some freedom of movement on the circular wall supporting floor and the tank supporting floor.

2. A safety wall according to claim 1, characterized in that elastically deformable sealing material is arranged between the circular floor and the circular wall supporting floor and the tank supporting floor.

* * * * *